US011882976B2

(12) United States Patent
Zoller et al.

(10) Patent No.: US 11,882,976 B2
(45) Date of Patent: Jan. 30, 2024

(54) LIQUID DISTRIBUTOR FOR A LIQUID-TRANSFER SYSTEM OF A CONVEYOR DISHWASHER, AND CONVEYOR DISHWASHER HAVING SUCH A LIQUID DISTRIBUTOR

(71) Applicant: ILLINOIS TOOL WORKS INC., Glenview, IL (US)

(72) Inventors: Frank Zoller, Offenberg-Elgersweier (DE); Matthias Lange, Ortenberg (DE); Gerhard Frei, Ohlsbach (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 753 days.

(21) Appl. No.: 16/647,089

(22) PCT Filed: Sep. 20, 2018

(86) PCT No.: PCT/US2018/051918
§ 371 (c)(1),
(2) Date: Mar. 13, 2020

(87) PCT Pub. No.: WO2019/067295
PCT Pub. Date: Apr. 4, 2019

(65) Prior Publication Data

US 2020/0229674 A1 Jul. 23, 2020

(30) Foreign Application Priority Data

Sep. 26, 2017 (DE) ..... 10 2017 122 323.1

(51) Int. Cl.
*A47L 15/24* (2006.01)

(52) U.S. Cl.
CPC ..... *A47L 15/241* (2013.01); *A47L 15/247* (2013.01); *A47L 2401/04* (2013.01);
(Continued)

(58) Field of Classification Search
None
See application file for complete search history.

(56) References Cited

U.S. PATENT DOCUMENTS 7,047,986 B2 5/2006 Ertle
2007/0295362 A1 12/2007 Doherty
(Continued)

FOREIGN PATENT DOCUMENTS

CN 103889298 A 6/2014
CN 106821261 A 6/2017
(Continued)

OTHER PUBLICATIONS

PCT, International Search Report and Written Opinion, International Application No. PCT/US2018/051918; dated Dec. 10, 2019, 9 pages.

*Primary Examiner* — Rita P Adhlakha
(74) *Attorney, Agent, or Firm* — THOMPSON HINE LLP

(57) ABSTRACT

A liquid distributor for a liquid-transfer system of a conveyor dishwasher has first, second and third connections. The liquid sprayed in at least one final-rinse zone of the conveyor dishwasher can be fed to the liquid distributor via the first connection, wherein some of the liquid fed to the liquid distributor can be discharged, via the second connection, to a line system which can be connected to the second connection, and wherein the rest of the liquid fed to the liquid distributor can be discharged, via the third connection, to at least one line system which can be connected to the third connection. The liquid distributor has an interchangeable aperture component, which defines the fraction of liquid which is fed to the liquid distributor via its first connection and is to be discharged, via the second connection, to the line system which can be connected to the second connection.

5 Claims, 4 Drawing Sheets

(52) U.S. Cl.
CPC ..... *A47L 2501/03* (2013.01); *A47L 2501/05* (2013.01); *A47L 2501/24* (2013.01)

(56) References Cited

U.S. PATENT DOCUMENTS

| | | | |
|---|---|---|---|
| 2008/0190463 | A1 | 8/2008 | Berner |
| 2012/0186609 | A1 | 7/2012 | Haltmayer |
| 2012/0199166 | A1 | 8/2012 | Braun |

FOREIGN PATENT DOCUMENTS

| | | | |
|---|---|---|---|
| CN | 106852673 | A | 6/2017 |
| DE | 102004030001 | | 1/2006 |
| DE | 10163184 | | 9/2008 |
| DE | 102011075020 | A1 | 10/2012 |
| DE | 102011084917 | A1 | 4/2013 |
| EP | 1046369 | | 10/2000 |
| WO | WO 2016018780 | | 2/2016 |

LIQUID DISTRIBUTOR FOR A LIQUID-TRANSFER SYSTEM OF A CONVEYOR DISHWASHER, AND CONVEYOR DISHWASHER HAVING SUCH A LIQUID DISTRIBUTOR

TECHNICAL FIELD

The present invention generally relates to the technical field of commercial dishwashing. Specifically, the invention relates to a liquid distributor for a liquid-transfer system of a conveyor dishwasher, and to a conveyor dishwasher, in particular commercial conveyor dishwasher, which is assigned a liquid-transfer system having a corresponding liquid-transfer distributor.

The conveyor dishwasher according to the invention has at least one main-wash zone and at least one final-rinse zone which is arranged downstream of the at least one main-wash zone, as seen in the transporting direction of the washware. The at least one final-rinse zone is designed in the form of a pump-action final-rinse zone and/or in the form of a fresh-water final-rinse zone and serves for spraying clean fresh water, to which a rinse-aid chemical is possibly assigned, onto the washware which is to be treated (fresh-water final-rinse zone) or for spraying recirculated fresh water, to which a rinse-aid chemical is possibly assigned, onto the washware which is to be treated (pump-action final-rinse zone).

By contrast, in the at least one main-wash zone of the conveyor dishwasher, wash liquid is sprayed onto the washware which is to be treated. The wash liquid is either the liquid which has already been used for final rinsing in the at least one final-rinse zone and to which a corresponding wash chemical has been added, or fresh water to which a wash chemical has been added.

Optionally, the conveyor dishwasher according to the invention may also have at least one pre-wash zone arranged upstream of the at least one main-wash zone, as seen in the transporting direction of the washware.

Conveyor dishwashers of the type considered herein are also referred to as multi-tank machines in the technical field of commercial dishwashing. In said machines, the washware to be treated is transported through the individual treatment zones of the conveyor dishwasher with the aid of a transporting apparatus. The conveyor dishwashers considered herein are in particular commercial conveyor dishwashers and may be in the form of flight-type warewashers or rack-conveyor warewashers. Unlike batch dishwashers, in the case of which the washware to be cleaned remains positionally fixed in the machine during the cleaning, in the case of conveyor dishwashers, the washware is transported through different treatment zones of the conveyor dishwasher.

In the case of conveyor dishwashers, the washware, such as for example dishes, pots, glasses, cutlery and other utensils to be cleaned, is conveyed through multiple treatment zones, such as for example a pre-wash zone or pre-wash zones, a main-wash zone or main-wash zones, a pump-action final-rinse zone or pump-action final-rinse zones, a fresh-water final-rinse zone or fresh-water final-rinse zones and a drying zone or drying zones. For the transport of washware in a transporting direction through the conveyor dishwasher, use is made of a transporting apparatus which generally has compartments for receiving washware. In the case of a flight-type warewasher, the compartments may be formed by support fingers on a conveyor belt of the transporting apparatus. In the case of rack-conveyor warewashers, dish racks in which compartments are able to be formed for receiving the washware to be treated serve as a transporting apparatus. In this case, it is conceivable that the dish racks are transported through the rack-conveyor warewasher by way of a conveying device.

In the pre-wash zone (preliminary cleaning area) of the conveyor dishwasher, lightly adhering dirt is removed from the washware to be treated. For this purpose, wash liquid is sucked in from a storage tank, assigned to said treatment zone, by a pump (pre-wash pump) and is sprayed onto the washware to be cleaned with the aid of suitable spray nozzles. Subsequently, the wash liquid flows back into the storage tank again and, there, is again sucked in by the pre-wash pump, which is designed in the form of a recirculation pump, and introduced into the recirculation circuit. Normally, the storage tank is covered by sieves in order to hold back relatively large dirt particles from the rinse liquid.

In the at least one main-wash zone arranged downstream of the pre-wash zone, as seen in the transporting direction of the washware, dirt particles still adhering to the washware to be treated are removed from the washware with the aid of a wash liquid, which is normally alkaline. For this purpose, the generally heated wash liquid is sucked in from the wash tank, assigned to the treatment zone, by a wash pump, which is designed in the form of a recirculation pump, and is sprayed over the washware with the aid of suitable positioned and oriented wash nozzles. Subsequently, the wash liquid flows back into the wash tank again and, there, is again sucked in by the wash pump, which is designed in the form of a recirculation pump. In this case too, the storage tank (wash tank) is normally covered by sieves, in order thereby to hold back relatively large dirt particles from the wash liquid.

As seen in the transporting direction of the washware, the at least one main-wash zone is adjoined by at least one final-rinse zone in which generally heated fresh water is sprayed onto the washware in order to rinse off the washware the wash liquid still adhering to the surface of the washware and any dirt residues still remaining. According to requirement, a rinse-aid chemical may be added to the (hot) fresh water sprayed in the at least one final-rinse zone.

The water circuit of today's conveyor dishwashers (multi-tank conveyor dishwashers) generally operates according to the principle of the cascading overflow. Here, the fresh water sprayed in the at least one final-rinse zone of the conveyor dishwasher is collected in a final-rinse tank assigned to the at least one final-rinse zone, and firstly runs into a lower wash tank, which—as seen in the transporting direction of the washware—is assigned to at least one main-wash zone arranged upstream of the at least one final-rinse zone. Subsequently, the liquid which is sprayed in the at least one main-wash zone and is collected via the wash tank assigned to the at least one main-wash zone runs into an even lower pre-wash tank of at least one pre-wash zone, which is optionally provided. As already stated, this at least one pre-wash zone is optionally provided and is—as seen in the transporting direction of the washware—arranged upstream of the at least one main-wash zone.

However, the principle of the cascading overflow entails the problem that, during the operation of the conveyor dishwasher, there is a risk that the wash liquid (wash liquor/detergent) situated in the wash tank of the at least one main-wash zone is diluted unnecessarily by the liquid sprayed in the at least one final-rinse zone, with the result that addition of wash chemical has to be increased. This in turn leads to increased consumption of resources and is generally not desired.

SUMMARY

On the basis of this problem, the present invention is based on the object of specifying a solution by way of which, during the operation of the conveyor dishwasher, the consumption of resources, and in particular chemicals, can be reduced.

Accordingly, the invention relates in particular to a liquid distributor for a liquid-transfer system of a conveyor dishwasher, wherein the liquid distributor has a first connection, a second connection and at least one third connection, wherein the liquid sprayed in at least one final-rinse zone of the conveyor dishwasher can be fed to the liquid distributor via the first connection, wherein some of the liquid fed to the liquid distributor can be discharged, via the second connection, to a line system which can be connected to the second connection, and wherein the rest of the liquid fed to the liquid distributor can be discharged, via the at least one third connection, to at least one line system which can be connected to the at least one third connection. In order to match the rates of flow through the second and at least one third connection of the liquid distributor, the liquid distributor according to the invention has an in particular interchangeable aperture component, which defines the fraction of liquid which is, or can be, fed to the liquid distributor via its first connection and is to be discharged, via the second connection, to the line system which can be connected to the second connection.

In particular, the solution according to the invention is characterized in that the aperture component is designed to be interchangeable, this being the case in particular with regard to the dirt load which is transported with the liquid which is fed to the liquid distributor. The aperture component, which is used for defining the fraction of the liquid which is to be conducted past the at least one main-wash zone, can be interchanged and/or cleaned in a simple manner, should relatively large dirt particles at least partially clog the aperture component during the operation of the conveyor dishwasher and thereby at least partially close off the bypass line of the liquid-transfer system.

The interchangeability of the aperture component has the further advantage that the effective flow cross section provided by the aperture component, which is ultimately decisive for the fraction of the liquid to be conducted past the at least one main-wash zone, can be matched in a simple manner to different machine types and/or to different modes of operation of the conveyor dishwasher in order thus to ensure that the liquid-transfer system assigned to the conveyor dishwasher is at all times optimally matched to the mode of operation of the conveyor dishwasher.

In other words, the replaceability of the aperture component allows the liquid distributor for the liquid-transfer system of the conveyor dishwasher to also function optimally when dirt particles are transported through the liquid distributor with the liquid, wherein furthermore, the liquid distributor makes it possible for it to be matched to different rates of flow as simply as possible.

In particular, it is basically conceivable that the at least one third connection of the liquid distributor is designed in the form of a connection stub in which the aperture component is, or can be, accommodated at least in part.

In a preferred realization of the liquid distributor according to the invention, it is provided that the liquid distributor contains a first channel, which flow-connects the first connection of the liquid distributor to the second connection of the liquid distributor. Furthermore, the liquid distributor contains at least one further (second) channel, which opens out into the first channel and flow-connects the latter to the at least one third connection of the liquid distributor. In this respect, it is advantageous if a channel axis formed by the second channel is arranged preferably at an acute angle in relation to a channel axis formed by the first channel, such that the mouth opening is oriented in the direction of the second connection of the liquid distributor.

Here, it is in particular expedient if the aperture component is designed in the form of an aperture-component insert which can be accommodated, at least in part, in the at least one second channel and in which at least one flow channel is formed. For example, the at least one flow channel may be designed in the form of a bore formed in the longitudinal direction of the aperture-component insert and/or in the form of a groove formed in the longitudinal direction of the aperture-component insert. Preferably, the at least one flow channel runs, at least in part, parallel to the channel axis formed by the at least one second channel.

In a particularly preferred realization of the liquid distributor according to the invention, the aperture component is designed in the form of an aperture-component insert and has a main body which is at least in part, and at least essentially, cylindrical or conical and which can be accommodated, at least in part, in the at least one second channel of the liquid distributor. In this case, the at least one flow channel is designed in the form of a bore or groove in the main body, said bore or groove running, at least in part, along the axis of symmetry of the cylindrical or conical main body.

According to embodiments of the liquid distributor according to the invention, the at least one flow channel is assigned a flow-channel region which runs, at least in part, radially in relation to the axis of symmetry of the cylindrical or conical main body and is formed in the main body such that the corresponding flow channel opens out in the lateral surface of the main body via the associated flow-channel region. In this respect, it is conceivable that the flow-channel region, which is assigned to the at least one flow channel, is formed in an end region of the cylindrical main body such that, in a state where the aperture component designed in the form of an aperture-component insert is accommodated in the at least one second channel, the at least one flow channel is, or can be, flow-connected to the first channel via its associated flow-channel region.

Alternatively or additionally, it is expedient if the flow-channel region, which is assigned to the at least one flow channel, is formed in an end region of the main body such that, in a state where the aperture component designed in the form of an aperture-component insert is accommodated in the at least one second channel, the flow-channel region opens out into the first channel on the rear side, as seen in relation to the flow direction.

Preferably, the at least one flow channel and the flow-channel region assigned thereto have an effective flow cross section which defines the fraction of liquid which is fed to the liquid distributor via the first connection and is, or can be, discharged per unit time via the third connection of the liquid distributor.

The invention is not restricted only to a liquid distributor of the above-described type, but also relates to a conveyor dishwasher having a transporting apparatus for transporting washware through the individual treatment zones of the conveyor dishwasher, wherein the conveyor dishwasher has at least one main-wash zone and at least one final-rinse zone which is arranged downstream of the at least one main-wash zone, as seen in the transporting direction of the washware. The at least one final-rinse zone is designed in the form of a pump-action final-rinse zone and/or in the form of a fresh-water final-rinse zone and serves for spraying recirculated fresh water, to which a rinse-aid chemical has possibly been added, or clean fresh water, to which a rinse-aid chemical has possibly been added, onto the washware which is to be treated.

It is optionally also possible for the conveyor dishwasher according to the invention to have at least one pre-wash zone arranged upstream of the at least one main-wash zone, as seen in the transporting direction of the washware.

According to the invention, the conveyor dishwasher is assigned a liquid-transfer system via which at least some of the liquid sprayed in the at least one final-rinse zone can be fed directly to the at least one optionally provided pre-wash zone, directly to a waste-water outflow or directly to a waste-water tank. In this respect, it is provided that the liquid-transfer system has an in particular interchangeable aperture component, which defines the fraction of liquid which is sprayed in the at least one final-rinse zone and is to be fed directly to the optionally at least one pre-wash zone, to the waste-water outflow or to the waste-water tank.

In this respect, it is conceivable for the liquid-transfer system of the conveyor dishwasher according to the invention to be assigned a liquid distributor according to the above-described type, that is to say a liquid distributor which in particular has a first connection, a second connection and at least one third connection, wherein the liquid sprayed in the at least one final-rinse zone of the conveyor dishwasher is, or can be, fed to the liquid distributor via the first connection, wherein some of the liquid fed to the liquid distributor is, or can be, discharged, via the second connection, to a line system connected to the second connection, and wherein the rest of the liquid fed to the liquid distributor can be discharged, via the at least one third connection, to at least one line system connected to the at least one third connection.

According to embodiments of the conveyor dishwasher according to the invention, it is provided in this respect that the first connection of the liquid distributor is, or can be, flow-connected preferably in a releasable manner to the delivery side of a pump, wherein the second connection of the liquid distributor is, or can be, flow-connected preferably in a releasable manner to a bypass line, and wherein the third connection of the liquid distributor is, or can be, flow-connected preferably in a releasable manner to a line system which is formed separately from the bypass line.

Alternatively, it is conceivable that the first connection of the liquid distributor is, or can be, flow-connected preferably in a releasable manner to the delivery side of a pump, wherein the third connection of the liquid distributor is, or can be, flow-connected preferably in a releasable manner to a bypass line, and wherein the second connection of the liquid distributor is, or can be, flow-connected preferably in a releasable manner to a line system which is formed separately from the bypass line.

The pump to whose delivery side the first connection of the liquid distributor is flow-connected preferably in a releasable manner is, in particular, a final-rinse pump, which is assigned to a pump-action final-rinse zone of the conveyor dishwasher. The bypass line to which the second connection of the liquid distributor is flow-connected preferably in a releasable manner is designed such that said bypass line, bypassing at least one main-wash zone of the conveyor dishwasher, opens out into a treatment zone which forms part of the conveyor dishwasher and is arranged upstream of the at least one main-wash zone of the conveyor dishwasher in one of the at least one main-wash zone, as seen in the transporting direction of the washware, into a waste-water tank or into a waste-water outflow. The line system, which is formed separately from the bypass line, is preferably flow-connected to a pre-rinse nozzle system of the conveyor dishwasher.

BRIEF DESCRIPTION OF THE DRAWINGS

Preferred embodiments of the solution according to the invention are described in more detail below on the basis of the appended drawings, in which.

DETAILED DESCRIPTION

Figure 1:
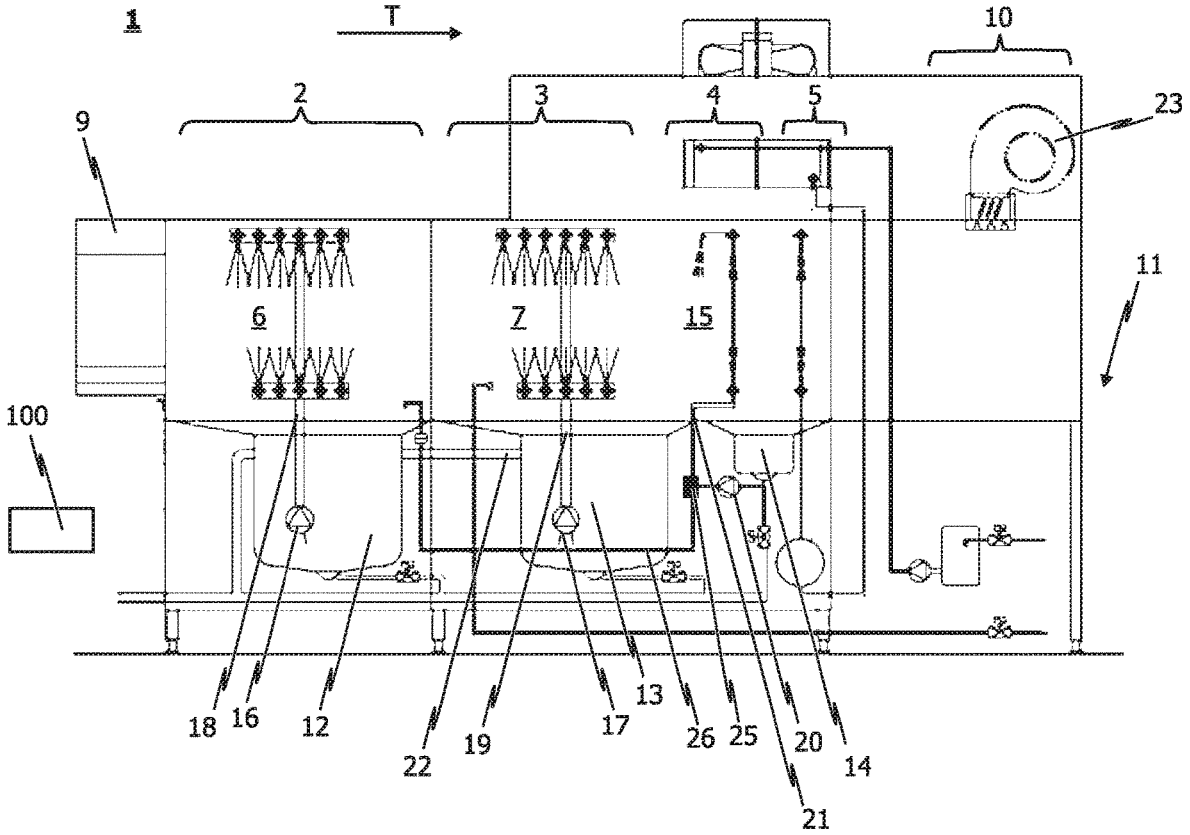
FIG. 1 shows a hydraulic diagram of an exemplary embodiment of the conveyor dishwasher according to the invention.

FIG. 1 shows, in a schematic longitudinal sectional view, an example of a conveyor dishwasher 1 which is formed according to the teachings of the present invention. The conveyor dishwasher 1 as per the illustration in FIG. 1 has a pre-wash zone 2 and a main-wash zone 3 which, as seen in the transporting direction T of the washware (not illustrated in FIG. 1), is arranged downstream of the pre-wash zone 2. As seen in the transporting direction T, a pump-action final-rinse zone 4 (post-wash or pre-rinse zone) and a fresh-water final-rinse zone 5 arranged downstream of the pump-action final-rinse zone 4 are arranged downstream of the main-wash zone 3 in the conveyor dishwasher 1 illusrated in FIG. 1.

In the illustrated conveyor dishwasher 1, at least the pre-wash zone 2 and the main-wash zone 3 are in each case formed as wash system 6 and wash system 7, respectively.

The washware, either directly received on a conveyor belt or held by racks, runs, in the transporting direction T, through an entrance tunnel 9, the following pre-wash zone 2, the main-wash zone 3, the pump-action final-rinse zone 4, the fresh-water final-rinse zone 5 and a drying zone 10 into an exit section 11.

Said treatment zones 2, 3, 4, 5 of the conveyor dishwasher 1 are each assigned spray nozzles via which liquid is sprayed onto the washware which is being transported by the conveyor belt through the respective treatment zones 2, 3, 4, 5. At least the pre-wash zone 2, the main-wash zone 3 and the pump-action final-rinse zone 4 are in each case assigned a tank 12, 13, 14 in which sprayed liquid is received and/or liquid for the spray nozzles of the relevant zones 2, 3, 4 is supplied.

The pre-wash zone 2, the main-wash zone 3 and the pump-action final-rinse zone 4 of the conveyor dishwasher 1 according to the embodiment illustrated in FIG. 1 each have a wash system 6, 7 or a rinse system 15. Each wash system 6, 7 is composed of a wash pump 16, 17, a line system 18, 19 connected to the wash pump 16, 17 and the spray nozzles (wash nozzles) connected to the line system 18, 19. The rinse system 15 has a final-rinse pump 20, a line system 21 connected to the delivery side of the final-rinse pump 20 and the spray nozzles (rinse nozzles) connected to the line system 21.

Furthermore, a control device 100 (illustrated merely schematically in the drawings) is provided, which (inter alia) serves for suitably actuating the respective wash pumps 16, 17 of the wash systems 6, 7 and the final-rinse pump 20 of the rinse system 15 during a wash/rinse process in order, at least intermittently, for liquid to be fed via the associated line system 18, 19, 21 to the spray nozzles of the nozzle system associated with the respective wash or rinse system 6, 7, 15.

In the conveyor dishwasher 1 illustrated in FIG. 1, final-rinse liquid in the form of fresh water, which may have further chemical additives, such as for example a rinse-aid chemical and/or a disinfection chemical, mixed with it, is sprayed onto the washware (not illustrated in FIG. 1) via the spray nozzles of the fresh-water final-rinse zone 5, said nozzles being arranged above and below the conveyor belt 58. In the fresh-water final-rinse zone 5, it is also possible for laterally arranged spray nozzles to be provided.

The liquid sprayed in the fresh-water final-rinse zone 5 is collected in the rinse tank 14 assigned to the pump-action final-rinse zone 4. The suction side of the final-rinse pump 20 assigned to the pump-action final-rinse zone 4 is flow-connected to the rinse tank 14 and serves for feeding to the spray nozzles of the rinse system 15 assigned to the pump-action final-rinse zone 4 some of the final-rinse liquid sprayed in the fresh-water final-rinse zone 5 and collected in the rinse tank 14.

After the spraying of the liquid fed to the spray nozzles of the rinse system 15 assigned to the pump-action final-rinse zone 4, said liquid is collected in the wash tank 13 assigned to the main-wash zone 3, where it is recirculated via the wash system 7 of the main-wash zone and is transported from zone to zone counter to the transporting direction T of the washware via a cascade system.

The remaining part of the final-rinse liquid sprayed in the fresh-water final-rinse zone 5 and collected in the rinse tank 14 is conducted directly into the pre-wash tank 12 of the pre-wash zone 2 via a liquid distributor 25 and a bypass line 26.

In specific terms, the final-rinse liquid sprayed in the fresh-water final-rinse zone 5 is collected in the tank (pump-action final-rinse tank 14) of the pump-action final-rinse zone 4, from which tank a fraction thereof is conveyed to the spray nozzles of the pump-action final-rinse zone 4 via the final-rinse pump 20 belonging to the rinse system 15 of the pump-action final-rinse zone 4. In the pump-action final-rinse zone 4, wash liquid is rinsed off the washware.

The liquid which is sprayed, and thus accumulates, in the pump-action final-rinse zone 4 flows into the wash tank 13 of the main-wash zone 3, is normally provided with a detergent or wash chemical and is sprayed onto the washware with the aid of a wash pump 17 belonging to the wash system 7 of the main-wash zone 3 via the spray nozzles (wash nozzles) of the wash system 7 belonging to the main-wash zone 3.

The wash liquid then flows from the wash tank 13 of the main-wash zone 3 into the pre-wash tank 12 of the pre-wash zone 2. The wash liquid collected in the pre-wash tank 12 is, in the pre-wash zone 2, sprayed onto the washware with the aid of a wash pump 16 belonging to the wash system 6 of the pre-wash zone 2 via the spray nozzles (pre-wash nozzles) of the wash system 6 belonging to the pre-wash zone 2 in order to remove coarse impurities from the washware.

Some of the wash liquid sprayed in the main-wash zone 3 passes into the wash tank (pre-wash tank 12) of the pre-wash zone 2 via an overflow system 22. As is also the case with the main-wash zone 3, the pre-wash zone 2 may be provided with a tank-covering sieve which is formed as a planar sieve.

In the conveyor dishwasher 1 illustrated in FIG. 1, the drying zone 10 has a drying system with a blower 23 which serves for forming an air circuit in the drying zone 10. In specific terms, the blower 23 serves for circulating the drying air within the drying zone 10.

As already stated, in the conveyor dishwasher schematically illustrated in FIG. 1, some of the liquid sprayed in the fresh-water final-rinse zone 5 is transported from zone to zone counter to the transporting direction T of the washware via a cascade system. The remaining part of the liquid sprayed in the fresh-water final-rinse zone 5 is conducted directly into the pre-wash tank 12 of the pre-wash zone 2 via a bypass line 26.

In order to be able to set that fraction of the liquid sprayed in the fresh-water final-rinse zone 5 which is to be fed directly to the pre-wash tank 12 via the bypass line 26, in the conveyor dishwasher according to the invention, use is made of a liquid distributor 25, which is indicated merely schematically in FIG. 1.

Figure 2:
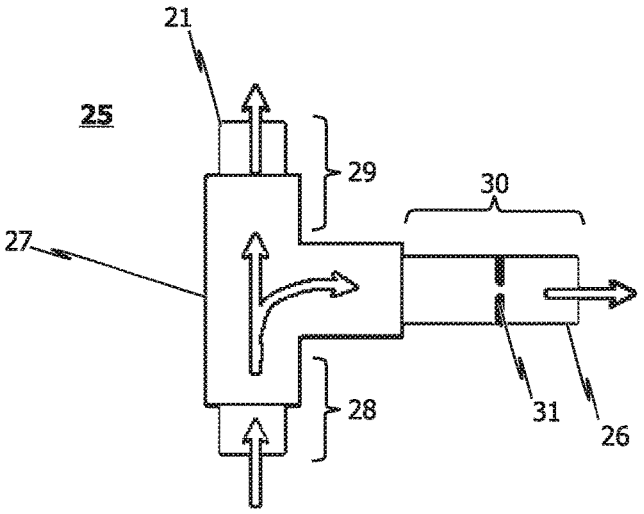
FIG. 2 schematically shows the structure of a first exemplary embodiment of the liquid distributor according to the invention.

FIG. 2 schematically illustrates the structure and the functioning of a first exemplary embodiment of a corresponding liquid distributor 25.

Accordingly, the liquid distributor 25 of this embodiment has a main body 27 with a first connection 28 which is connected, or is able to be connected, to the delivery side of the final-rinse pump 20 (pre-rinse pump) of the conveyor dishwasher 1, a second connection 29 which is flow-connected, or is able to be flow-connected, to the line system 21 of the rinse system 15 assigned to the pump-action final-rinse zone 4, and a third connection 30 which is flow-connected, or is able to be flow-connected, to the bypass line 26.

Furthermore, the liquid distributor 25 is assigned an aperture component 31 (aperture plate), which is designed so as to be interchangeable and via which that fraction of liquid fed, or able to be fed, to the liquid distributor 25 via the first connection 28 thereof which is to be discharged via the second connection 29 to the rinse system 15 assigned to the pump-action final-rinse zone 4 is defined.

Even though, by way of the liquid distributor 25 according to the embodiment schematically illustrated in FIG. 2, it is possible to set the quantity of the so-called "bypass liquid", that is to say that fraction of the liquid fed to the liquid distributor 25 which is to be discharged to the bypass line 26, in a manner which is easy to realize, the dirt load which is transported with the bypass water could however be a problem in this system since relatively large dirt particles clog the (interchangeable) aperture plate 31 and thereby can at least partially close off the bypass.

This problem no longer occurs in the further (second) exemplary embodiment of the liquid distributor 25 according to the invention, which embodiment will be described in more detail below with reference to the illustrations in FIGS. 3 to 5.

In specific terms, the liquid distributor 25 according to the further (second) exemplary embodiment likewise has a first connection 28, a second connection 29 and a third connection 30. Via the first connection 28 of the liquid distributor 25, the liquid sprayed in the at least one fresh-water final-rinse zone of the conveyor dishwasher 1 is able to be fed to the liquid distributor 25. Via the second connection 29 of the liquid distributor 25, some of the liquid fed to the liquid distributor 25 is discharged to a line system (line system 21 in this case) which is able to be connected to the second connection 29, and via the at least one third connection 30, the rest of the liquid fed to the liquid distributor 25 is discharged to at least one line system (bypass line 26 in this case) which is able to be connected to the at least one third connection 30.

As is also the case in the first exemplary embodiment as per FIG. 2, the further exemplary embodiment of the liquid distributor 25 according to the invention has a preferably interchangeable aperture component 31 via which that fraction of the liquid fed, or able to be fed, to the liquid distributor 25 via the first connection 28 thereof which is to be discharged via the second connection 29 to the line system which is able to be connected to the second connection 29 is defined.

In specific terms, it is in this case provided that the at least one third connection 30 of the liquid distributor 25 is designed in the form of a connection stub in which the aperture component 31, which is designed in the form of an aperture-component insert, is accommodated or is able to be accommodated at least in part.

Figure 4A:
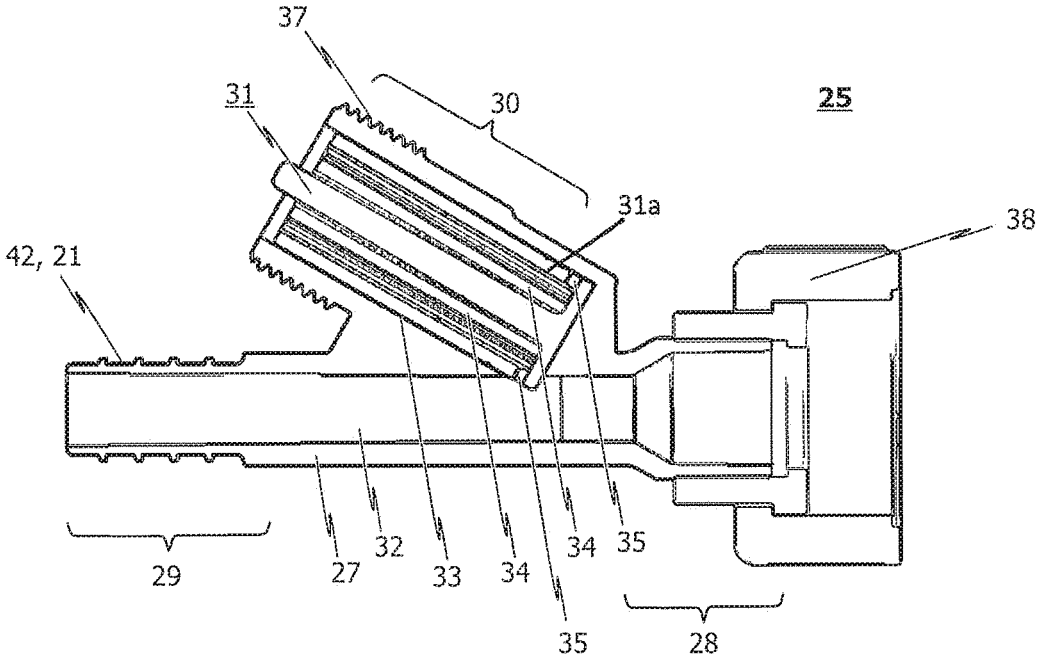
FIG. 4*a* schematically shows the liquid distributor as per FIG. 3 in a side sectional view.
Figure 4B:
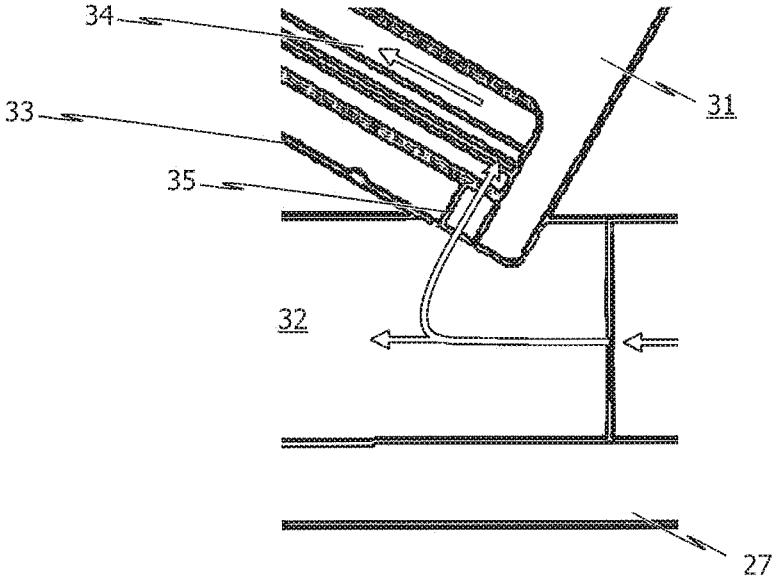
FIG. 4*b* schematically shows an enlarged detail from FIG. 4*a*.

From the sectional views in FIG. 4*a* and FIG. 4*b*, it can be gathered in particular that, in the liquid distributor 25 of this exemplary embodiment, a first channel 32, which flow-connects the first connection 28 of the liquid distributor 25 to the second connection 29 of the liquid distributor 25, is formed. Furthermore, a further (second) channel 33, which opens out into the first channel 32 and flow-connects the latter to the at least one third connection 30 of the liquid distributor 25, is formed in the liquid distributor 25. In this case, the aperture component 31 designed in the form of an aperture-component insert is formed in the second channel 33 of the liquid distributor 25 at least in part.

Figure 5A:
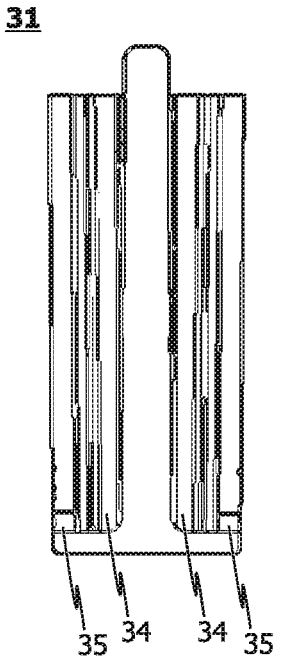
FIGS. 5*a* to 5*c* schematically show different views of an aperture-component insert used in the exemplary embodiment of the liquid distributor as per FIG. 2.

It can be gathered from the sectional view in FIG. 4*b* and the sectional view in FIG. 5*a* that at least one flow channel 34 is formed in the aperture component 31 designed in the form of an aperture-component insert. In specific terms, the at least one flow channel 34 is designed in the form of a bore formed in the longitudinal direction of the aperture-component insert. However, in this respect, it is also conceivable for the flow channel 34 to be designed in the form of a groove formed in the longitudinal direction of the aperture-component insert.

Figure 3:
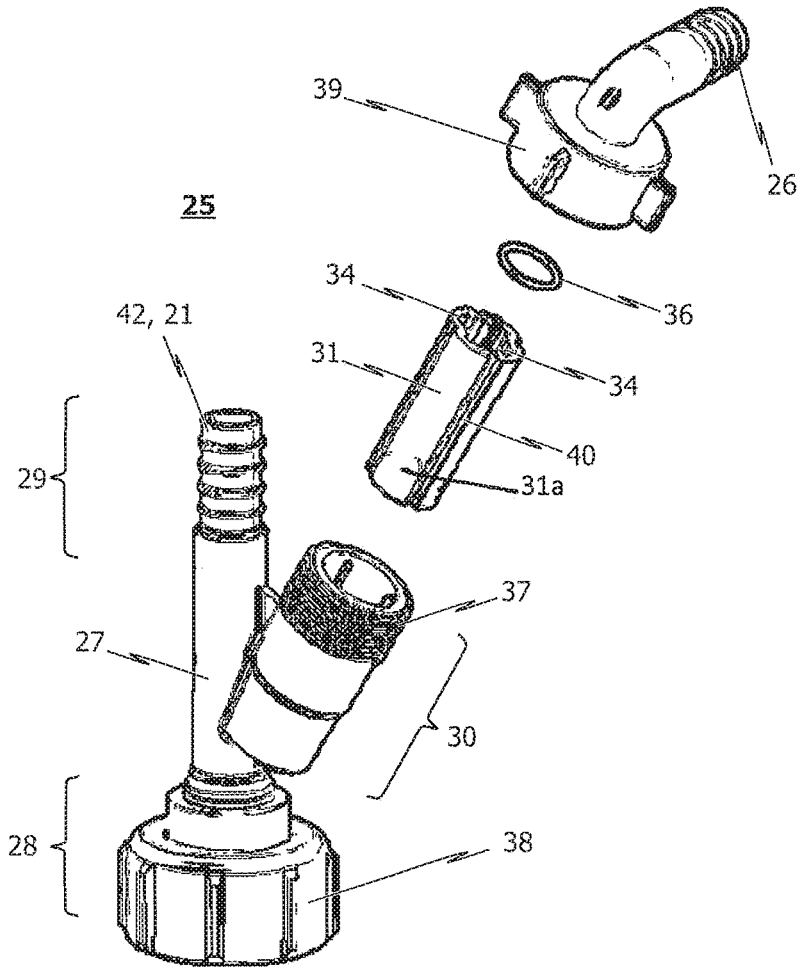
FIG. 3 schematically shows a second exemplary embodiment of the liquid distributor according to the invention in an isometric view.

Even though the aperture component 31 designed in the form of an aperture-component insert has a cylindrical main body 31*a* in the exemplary embodiment of the liquid distributor 25 according to the invention, which embodiment is shown in FIGS. 3 to 5, it is in this respect conceivable for the main body 31*a* to be designed to be conical or the like, for example.

It can be gathered from the illustrations in FIG. 4*a* and FIG. 4*b* that, in the exemplary embodiment shown there, the respective flow channels 34, which are formed as a bore in the cylindrical main body 31*a* of the aperture-component insert, are each assigned a flow-channel region 35 which runs, at least in part, radially in relation to the cylinder axis of the cylindrical main body 31*a*. This radially running flow-channel region 35 is formed in the cylindrical main body 31*a* in particular such that the corresponding flow channel 34 opens out in the lateral surface of the cylindrical main body 31*a* via the flow-channel region 35 assigned thereto.

It can be gathered from the enlarged view as per FIG. 4*b* that the radially running flow-channel region 35 assigned to the corresponding flow channel 34 is formed in an end region of the cylindrical main body of the aperture-component insert such that, in a state where the aperture component 31 designed in the form of an aperture-component insert is accommodated in the at least one second channel 33 of the liquid distributor 25 (cf. FIG. 4*a*), the corresponding flow channel 34 is, via the radially running flow-channel region 35 thereof assigned thereto, flow-connected, or able to be flow-connected, to the first channel 32 of the liquid distributor 25.

In particular, the radially running flow-channel region 35 assigned to the corresponding flow channel 34 is formed in an end region of the cylindrical main bodyof the aperture component 31, designed in the form of an aperture-component insert, such that, in a state where the aperture component 31 designed in the form of an aperture-component insert is accommodated in the second channel 33 of the liquid distributor 25 (cf. FIG. 4*a*), the radially running flow-channel region 35 opens out into the first channel 32 of the liquid distributor 25 rearwardly in relation to the flow direction. In this way, potential clogging of the aperture-component insert by dirt particles can be effectively prevented.

The respective flow channels 34, formed in the main body 31*a* of the aperture-component insert, and the radially running flow-channel regions 35, assigned to said flow channels 34, have, in each case together, an effective flow cross section which defines that fraction of the liquid added to the liquid distributor 25 via the first connection 28 which is discharged, or is to be discharged, via the third connection 30 of the liquid distributor 25.

Preferably, and as can be gathered in particular from the sectional view in FIG. 5*a*, multiple flow channels 34 running parallel and, correspondingly, radially running flow-channel regions 35 assigned to said flow channels 34 are provided in the cylindrical main body 31*a*, wherein the respective flow channels 34, with the flow-channel regions 35 assigned thereto, differ from one another via their respective effective flow cross section.

With regard to the further exemplary embodiment of the liquid distributor 25 according to the invention, it thus remains to state the following in summary:

As per the realization, schematically illustrated in FIG. 3, of the liquid distributor 25 according to the invention, the latter essentially consists of the Y-shaped main body 27 (plastic injection-molded part), the aperture-component insert (aperture component 31) and an O-ring 36 for sealing the thread 37.

The main body 27 is screwed onto the final-rinse pump 20 or pre-rinse pump with the aid of a union nut 38. The straight outlet (second connection 29) is connected to the rinse system 15 of the conveyor dishwasher 1 via a hose. The aperture-component insert (aperture component 1) is pushed into the connection (third connection 30) of the bypass line 26 and is sealed off from the hose connection 39 of the bypass by way of the O-ring 36. The bypass outlet is connected to the pre-wash tank 12 via a hose.

The water is forced into the Y-shaped main body 27 by the pressure which has built up in the pre-rinse pump 20. In said body, the volume stream is split in two directions in proportion to the different cross sections. The larger fraction flows straight through the main body 27 into the connected rinse system 15 of the conveyor dishwasher 1. The smaller volume stream flows through the aperture-component insert into the bypass.

Figure 5B:
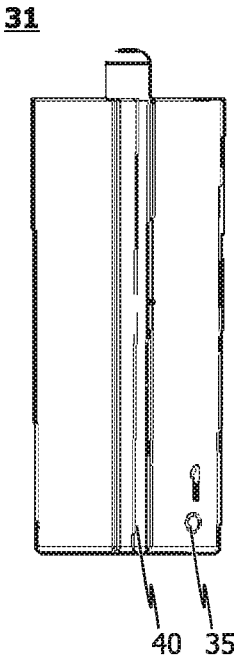
Figure 5C:
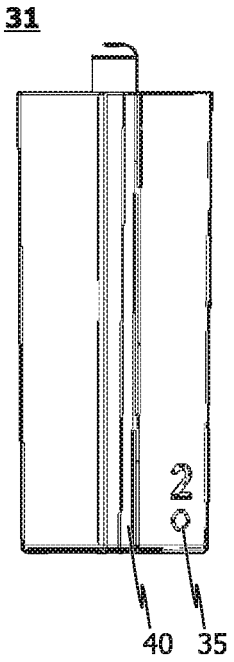

Multiple flow channels 34 (bores) having different diameters may—as indicated in FIG. 5*b* and FIG. 5*c*—be arranged on the periphery of the aperture-component insert (aperture component). By turning the aperture-component insert, it is thus possible for different volume streams to be realized in the bypass line 26 (only two being shown in the example, but several being perfectly possible). The aperture-component insert is securely positioned in the main body 27 by way of the grooves 40, which are likewise situated on the periphery.

If the second embodiment of the liquid distributor 25 according to the invention is compared with the first embodiment as per FIG. 2, a major advantage is then that the liquid distributor 25 according to the second embodiment is not clogged as a result of the dirt load present in the water. The decisive factor for this is the positioning of the cross-sectional change in the volume stream. Since this is situated in the middle of the main volume stream between the first and second connections 28, 29 of the liquid distributor 25 in the case of an aperture plate, it is necessary for each dirt particle to pass through the constriction. If the particle is larger than the hole of the aperture component 31, the latter is clogged immediately.

If, by contrast, the liquid distributor 25 according to the second embodiment of the invention is considered, then firstly the cross-sectional change is situated at the edge of the volume stream, and secondly this is applied rearwardly in relation to the flow direction (in the dead space). The dirt particles are therefore entrained by the quicker main flow between the first and second connections 28, 29 of the liquid distributor 25 and conducted past the constriction.

In addition, the particles are prevented from being sucked in through the bypass line 26 by vortices which arise owing to the aperture-component insert 31, which projects into the main volume stream between the first and second connections 28, 29 of the liquid distributor 25.

From this, it is evident that the function of the bypass is maintained by the liquid distributor 25 according to the invention even in the case of high dirt loads. In addition, the bypass volume stream can, by turning the aperture-component insert 1, be changed very easily or matched to other machine types.

In the described embodiments, because the aperture component 31 controls the amount of incoming flow from first connection 28 that will discharge to the third connection 30, the aperture component 31 also controls the amount of the incoming flow that will discharge to second connection 29. In other words, more flow to third connection 30, means less flow to second connection 29, and vice versa.

The invention is not restricted to the exemplary embodiments shown in the drawings, but rather emerges from a juxtaposition of all the features disclosed herein.

In particular, instead of the union nut 38 on the main body 27 for the pump connection, it is also possible for a hose connection to be provided. In this way, the system can be inserted between two hoses in any desired manner.

Furthermore, instead of the hose connection 42 on the main body 27, it is also possible for a second union nut to be provided. In this way, the system can be inserted between two tubes in any desired manner.

Furthermore, instead of a union nut and hose connection, it is also possible for a welding stub to be provided. In this way, all conceivable types of welding fittings may be fitted to the system.

Furthermore, the hose connection 42 situated on the main body 27 could be closed off. The system would thereby no longer be a bypass, but it would be possible to use the function of the settable aperture component 31 for matching the volume stream in a water line.

The invention claimed is:

1. A conveyor dishwasher having a transporting apparatus for transporting washware therethrough, comprising:

a plurality of individual treatment zones, including a final rinse zone and at least one upstream treatment zone;

a liquid transfer system including a liquid distributor having a first connection, a second connection and a third connection, wherein the first connection is connected to receive a liquid sprayed in the final-rinse zone and fed to the liquid distributor via the first connection, the second connection is connected to a first line system, the third connection is connected to a third line system, wherein some of the liquid fed to the liquid distributor via the first connection is discharged, via the second connection, to the first line system, and wherein the rest of the liquid fed to the liquid distributor via the first connection can be discharged, via the third connection, wherein the liquid distributor has an aperture component with at least one flow channel therethrough, wherein the aperture component defines the fraction of the liquid which is fed to the liquid distributor via the first connection and is discharged, via the second connection, wherein the aperture component includes a component main body with a laterally outer surface and the at least one flow channel opens out through the laterally outer surface to receive liquid;

wherein the liquid distributor has a main body defining a first channel, which flow-connects the first connection to the second connection, and a connection stub extending from the main body and defining a second channel, and on which the third connection is formed, wherein the second channel opens out into the first channel and flow-connects the first channel to the third connection;

wherein the aperture component is removably positioned within the connection stub, and the component main body is a cylindrical main body, wherein a radially running flow channel region is formed in the cylindrical main body so as to be exposed on the laterally outer surface of the cylindrical main body, and the radially running flow channel region runs, at least in part, radially relative to a cylinder axis of the cylindrical main body, and an inlet side of the radially running flow channel region is exposed within the first channel to receive liquid.

2. The dishwasher as claimed in claim 1, wherein the at least one flow channel is configured, at least in part, in the form of a bore formed in a longitudinal direction of the aperture component and/or in the form of a groove formed in the longitudinal direction of the aperture component.

3. The dishwasher as claimed in claim 1, wherein the at least one flow channel runs, at least in part, parallel to a channel axis formed by the second channel.

4. The dishwasher as claimed in claim 1, wherein inlet side opens out into the first channel on a rear side, as seen in relation to a flow direction along the first channel.

5. The dishwasher as claimed in claim 1, wherein the at least one flow channel and the radially running flow-channel region have an effective flow cross section which defines the fraction of liquid which is fed to the liquid distributor via the first connection and is discharged via the third connection.

* * * * *